US009901775B2

(12) United States Patent
Sykes

(10) Patent No.: US 9,901,775 B2
(45) Date of Patent: Feb. 27, 2018

(54) ISOMETRIC/ISOTONIC NECK EXERCISE DEVICE

(71) Applicant: Steven Douglas Sykes, Santa Rosa, CA (US)

(72) Inventor: Steven Douglas Sykes, Santa Rosa, CA (US)

(73) Assignee: Steven Douglas Sykes, Santa Rosa, CA (US)

( * ) Notice: Subject to any disclaimer, the term of this patent is extended or adjusted under 35 U.S.C. 154(b) by 0 days.

(21) Appl. No.: 14/675,663

(22) Filed: Mar. 31, 2015

(65) Prior Publication Data

US 2016/0287935 A1 Oct. 6, 2016

(51) Int. Cl.

| | |
|---|---|
| ***A63B 22/00*** | (2006.01) |
| ***A63B 23/025*** | (2006.01) |
| ***A63B 21/00*** | (2006.01) |
| *A63B 21/002* | (2006.01) |
| *A63B 21/04* | (2006.01) |
| *A63B 21/055* | (2006.01) |

(52) U.S. Cl.

CPC ..... *A63B 23/025* (2013.01); *A63B 21/4003* (2015.10); *A63B 21/0023* (2013.01); *A63B 21/0442* (2013.01); *A63B 21/0552* (2013.01); *A63B 2209/02* (2013.01); *A63B 2209/10* (2013.01)

(58) Field of Classification Search

USPC ..... 482/10–11, 91, 148; 128/848; 606/204.35

See application file for complete search history.

(56) References Cited

U.S. PATENT DOCUMENTS

| | | | | | |
|---|---|---|---|---|---|
| 559,270 | A * | 4/1896 | Edwards | A63B 21/4003 | 297/395 |
| 1,517,147 | A * | 11/1924 | Burnett | A63B 23/025 | 482/10 |
| 1,543,346 | A * | 6/1925 | Titus | A63B 23/025 | 482/10 |
| 2,571,461 | A * | 10/1951 | Livingston | A61B 17/135 | 128/DIG. 20 |

(Continued)

OTHER PUBLICATIONS

2Fit® 2fit Nylon Head Harness Neck Strength Head Strap Weight Lifting Exercise Fitness Belt (https://www.amazon.com/Harness-Strength-Lifting-Exercise-Fitness/dp/B009YZNF4A).Internet Archive wayback date Apr. 22, 2014.*

*Primary Examiner* — Stephen R Crow

(57) ABSTRACT

An isometric/isotonic neck exercise device designed to attach around a persons head, at the forehead level as would a typical headband be worn. Attached to this band as an integral component of this device to provide the medium by which the device can perform the function for which it is designed, is a nylon strap that includes two alloy "D" configuration rings for accessory attachment continuity. Once the device is secured in place on the user, accessory resistance band/s anchored from a fixed point at one end, are attached to this device with the other end of the resistance band/s to then provide a multitude of exercises that focus on all muscle groups and tendons in the neck, mid and upper spine to specifically and dramatically improve mobility and motion, for strength, fitness and rehabilitation purposes at levels which have not previously been obtained.

1 Claim, 5 Drawing Sheets

(56) References Cited

U.S. PATENT DOCUMENTS 2,740,399 A * 4/1956 Judovich ..... A61H 1/0218 602/36
3,118,443 A * 1/1964 Dykinga ..... A61H 1/0218 128/DIG. 15
3,388,405 A * 6/1968 Simpson ..... A42B 3/14 2/418
3,540,439 A * 11/1970 Gaylord, Jr. ..... A61H 1/0218 602/36
3,820,780 A * 6/1974 Tarbox ..... A63B 21/0603 128/97.1
4,984,786 A * 1/1991 Lemke ..... A63B 21/4001 482/105
4,988,093 A * 1/1991 Forrest, Sr. ..... A63B 21/0602 2/413
4,991,573 A * 2/1991 Miller ..... A61F 5/028 128/106.1
5,086,758 A * 2/1992 Schiek, Sr. ..... A61F 5/028 128/876
5,158,510 A * 10/1992 Lemire ..... A63B 21/4001 482/51
5,336,139 A * 8/1994 Miller ..... A63B 21/4025 482/10
5,505,677 A * 4/1996 Hinds ..... A63B 21/0004 482/10
5,588,940 A * 12/1996 Price ..... A63B 21/4005 224/259
5,626,544 A * 5/1997 Foresto ..... A63B 21/0552 482/10
6,036,625 A * 3/2000 Woodruff ..... A63B 21/0552 482/121
6,190,288 B1 * 2/2001 Fisher ..... A61H 36/00 2/300
6,729,511 B2 * 5/2004 Dent, III ..... B65G 7/12 224/157
6,939,269 B2 * 9/2005 Makofsky ..... A63B 21/154 482/10
7,331,493 B2 * 2/2008 Dent, III ..... A44B 11/08 224/157
7,404,216 B1 * 7/2008 Paramore ..... A63B 71/1216 2/406
7,722,301 B2 * 5/2010 Rosenblum ..... A63B 22/18 2/425
7,775,938 B1 * 8/2010 Anderson ..... A61F 5/05891 482/10
7,908,672 B2 * 3/2011 Butler ..... A63B 21/0605 2/162
8,321,972 B1 * 12/2012 Vetter ..... A61G 7/1023 5/81.1 R
8,534,233 B1 * 9/2013 Han ..... A01K 27/003 119/792
8,535,256 B2 * 9/2013 Taylor ..... A61F 13/06 2/69
8,613,690 B1 * 12/2013 Thompson ..... A63B 23/025 482/10
8,807,403 B2 * 8/2014 Nielsen ..... A45F 3/14 224/157
8,876,679 B2 * 11/2014 DeMarco ..... A63B 1/00 482/129
9,486,663 B2 * 11/2016 DeMarco ..... A63B 21/068
9,573,016 B2 * 2/2017 Haddad ..... A63B 21/4043
2003/0228955 A1 * 12/2003 Makofsky ..... A63B 21/154 482/10
2004/0058780 A1 * 3/2004 Edgeton ..... A63B 21/055 482/10
2007/0161473 A1 * 7/2007 McBride ..... A63B 21/065 482/105
2012/0165169 A1 * 6/2012 Gatherer ..... A63B 71/0054 482/139
2013/0085041 A1 * 4/2013 Jolly ..... A63B 23/025 482/10
2016/0101309 A1 * 4/2016 Schreiber ..... A61F 5/0127 482/124
2017/0028244 A1 * 2/2017 Schreiber ..... A63B 21/0557

* cited by examiner

ISOMETRIC/ISOTONIC NECK EXERCISE DEVICE

BACKGROUND OF THE INVENTION

This device is specifically designed for use in the fitness, health, and rehabilitation industries. It is used by fitness enthusiast to further develop all muscle groups in the neck, mid and upper spine and has incomparable benefits in the area of rehabilitation for any and all injury related issues of the neck, mid and upper spine. All cited references display some form of similarity in function, performance, or purpose to this neck exercise device.

REFERENCES CITED

U.S. Pat. No. 7,468,019
U.S. Pat. No. 6,788,968
U.S. Pat. No. 6,517,506
U.S. Pat. No. 5,162,027
U.S. Pat. No. 6,036,625
U.S. Pat. No. 3,118,443
U.S. Pat. No. 1,517,147
U.S. Pat. No. 2,855,202
U.S. Pat. No. 2,051,366
U.S. Pat. No. 4,537,393
U.S. Pat. No. 4,832,333
U.S. Pat. No. 4,278,249
U.S. Pat. No. 4,066,259
U.S. Pat. No. 4,219,193
U.S. Pat. No. 6,179,747
U.S. Pat. No. 8,840,528
U.S. Pat. No. 5,984,836

BRIEF SUMMARY OF INVENTION

This device is based from the foundation of an open ended cotton strap that provides the nucleus for which this device is constructed, manufactured and utilized. In order for this device to be used as intended, a Velcro [hook & loop] material is attached at each end of the cotton strap, with the hook pad portion on the outer side at one end, and the loop pad portion on the inner side at the other end of the cotton strap so as in joining or connecting the opposing pads together as intended, then becomes the element with which this exercise device is to be properly positioned and secured in place for use. Attached to this cotton strap on the outer parameter at two separate opposing points is a nylon strap that becomes the medium by which this device is able to function as intended. Attached to the nylon strap are two alloy "D" configuration rings incorporated within the construction of this device. These rings are used to facilitate the attachment of an anchored accessory resistance band/s to complete the intended function and use of this exercise device. Attached to the inner parameter of the cotton strap is a neoprene rubber type strip. This rubber strip covers the inner surface of the strap and is used to hold the device securely in place on the users head while ensuring a satisfactory level of padding for comfort during use. A separate cotton retaining head strap is included and can be used to ensure that the device retains a secure consistent position on the users head for optimum function. This retaining strap is placed across the top of the head and attaches to the exercise device using Velcro [hook & loop] material attached in the appropriately designated positions as shown within the illustrations provided. Based on the design of this exercise device, it is capable of allowing for a full range of lateral and rotational motion neck exercises at a level that cannot be achieved by any prior devices. Depending on the requirements from the user, the object of this device from a health standpoint is to rejuvenate and rehabilitate injured or damaged muscles and tendons in the neck, mid and upper spine to regain a proper and acceptable level of mobility. From a fitness standpoint, the user is capable of attaining nearly unlimited muscle and tendon strength and flexibility in all areas of the neck, mid and upper spine.

DETAILED DESCRIPTION OF INVENTION

Figure 1:
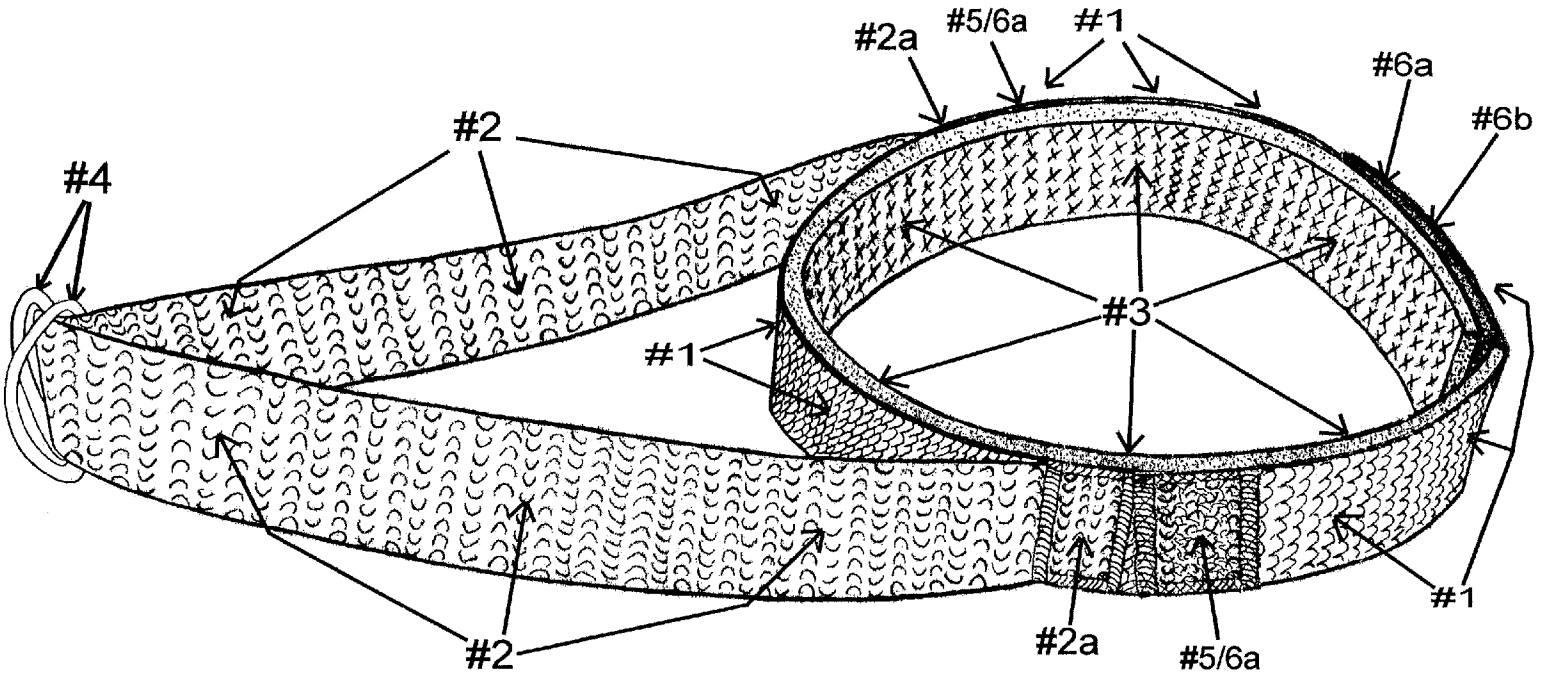
FIG. 1 is an upper perspective side illustration of this exercise device in the secured position.

This exercise device is based from the foundation of an open ended cotton strap that provides the basis for which this device is designed, constructed and utilized. In order for this exercise device to be used as intended, a Velcro [hook & loop] material is attached at each end of the cotton strap. The hook pad portion is attached on the outer side at one end of the cotton strap, and the loop pad portion is attached on the inner side at the other end of the cotton strap so as in joining or connecting the opposing pads together as intended, it then becomes the element with which this exercise device is to be properly positioned and secured in place for use. Attached to this cotton strap on the outer parameter at two separate opposing points is a nylon strap that becomes the medium by which this device is able to function as intended. Attached with the nylon strap are two alloy "D" configuration rings incorporated within the construction of this exercise device. These rings are used to facilitate the attachment from one end, of an accessory resistance band's, of which the other end of the resistance band/s would be anchored to a fixed point, in order to complete the intended function and use of this neck exercise device. Attached to the inner parameter of the cotton strap is a neoprene rubber type strip. This strip covers the inner surface of the strap and is used to hold the device securely in place on the users head while ensuring a satisfactory level of comfort during use. A separate cotton retaining strap is included and can be used to ensure that the device retains a consistent position on the head for optimum function. This retaining strap is placed across the top of the head and held in place on the exercise device using Velcro [hook & loop] material attached in the appropriately designated positions as shown within the illustrations provided. The complete combination and intensity of motion resistance exercises with which this neck exercise device provides to the user far exceeds any other similarly claimed devices in every aspect and every industry involved with Fitness, Health, and Rehabilitation.

FIG. 1

Illustrates the exercise device with all the components that comprise the device to be complete as follows:

Item #1 represents the cotton webbing strap material that provides the primary foundation with which all the other components shown and described are attached, in order for this device to provide the proper function as designed, constructed and intended for the user.

Item #2 represents the nylon webbing strap material of which each end is attached [as sewn] onto the outer circumference of the cotton webbing strap [#1] at the designated opposing points indicated as #2*a*. One of these attachment points is illustrated as shown, [FIG. 1], on the side of the device. The other attachment point #2*a* as indicated on the opposing side of this device is not visible in this illustration, [FIG. 1], but is shown and visible on FIGS. This nylon strap becomes the medium by which this device is able to perform the exercise functions as designed and intended for the user.

Item #3 represents a neoprene rubber type material which is attached to the inner circumference of the cotton strap [#1] by either being sewn on, or adhesively bonded. This rubber material [#3] attached to the cotton strap [#1] provides comfort to the user and prohibits movement of the device during use.

Item #4 indicates two alloy "D" configuration rings that are specifically incorporated within the construction of this device, in conjunction with the nylon strap [#2]. These "D" rings are used to facilitate the attachment from one end of an accessory resistance band/s, of which the other end of the resistance band's would be anchored to a fixed point in order to complete the intended function and use of this exercise device.

Figure 1A:
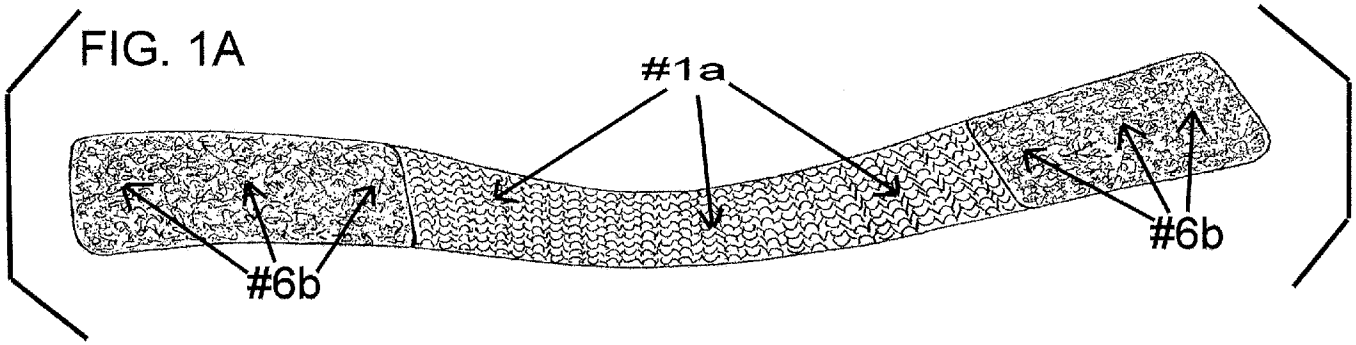
FIG. 1A is a perspective illustration of the retaining head strap.

Item #5/6*a* indicates the two opposing attachment points where which a Velcro [hook #6*a*] material pad is sewn onto each outer circumference side of the cotton strap [#1] and used to secure in place each end of the retaining head strap illustrated in FIG. 1A. One of these attachment points #516*a* and the Velcro [hook #6*a*] material pad is visible as shown on the side of this exercise device, [FIG. 1]. The other attachment point #5/6*a* and Velcro [hook #6*a*] material pad as indicated on the opposing outer side of this exercise device is not visible in this illustration [FIG. 1], but is shown and visible in FIG. 5.

Figure 3:
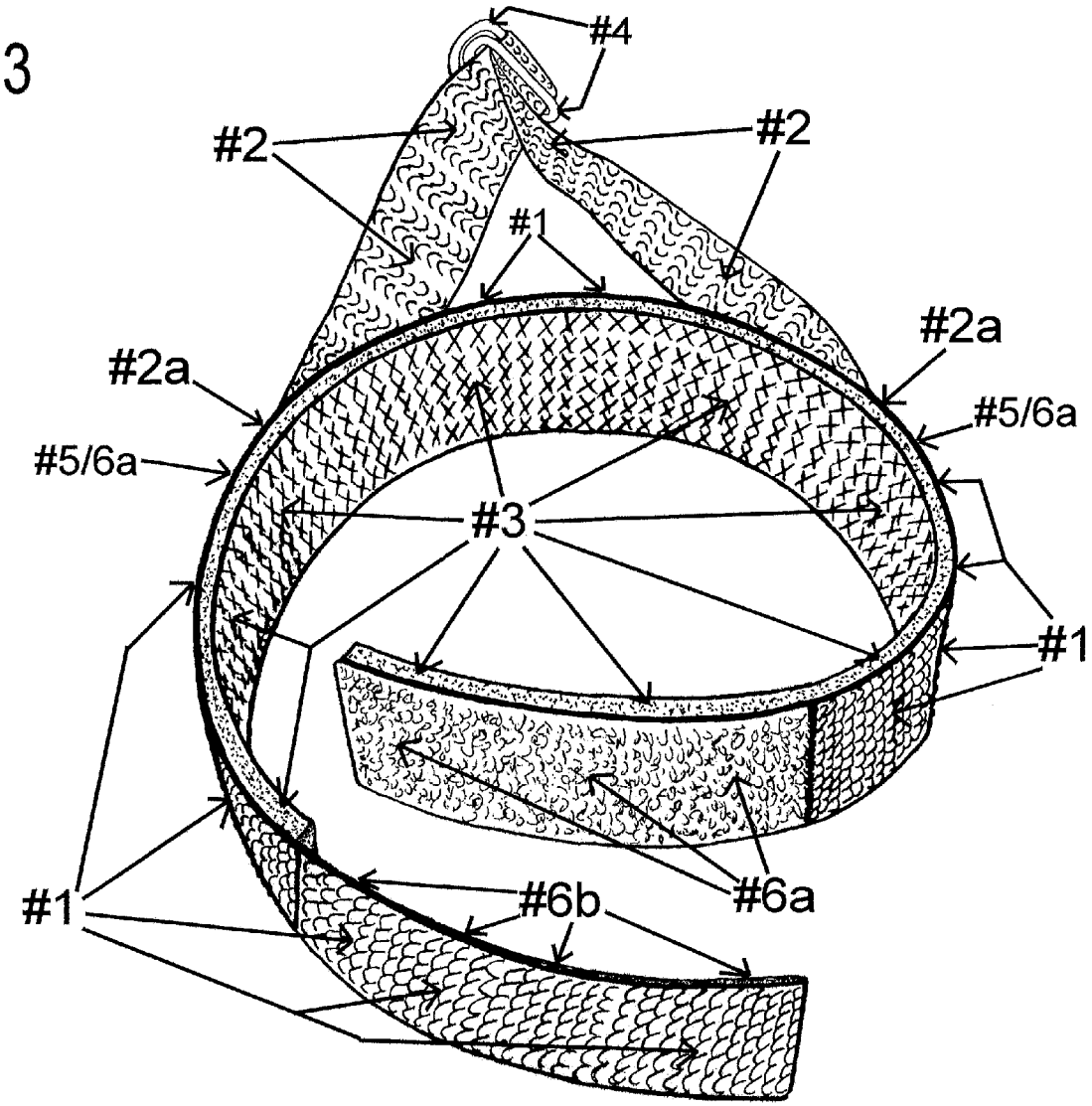
FIG. 3 is an upper perspective rearward illustration of this exercise device in the unsecured position without the retaining head strap [FIG. 1A].

Item #6*a* indicates the Velcro [hook] material pad, [not visible], attached [as sewn] onto one end of the cotton strap [#1], outer side as shown secured to the Velcro [loop #6*b*] material pad, [not visible] which is attached [as sewn] on to the opposing end inner side of the cotton strap [#1] of this exercise device. An illustration of this Velcro [hook #6*a*] material pad is shown and is visible in FIG. 3.

Figure 2:
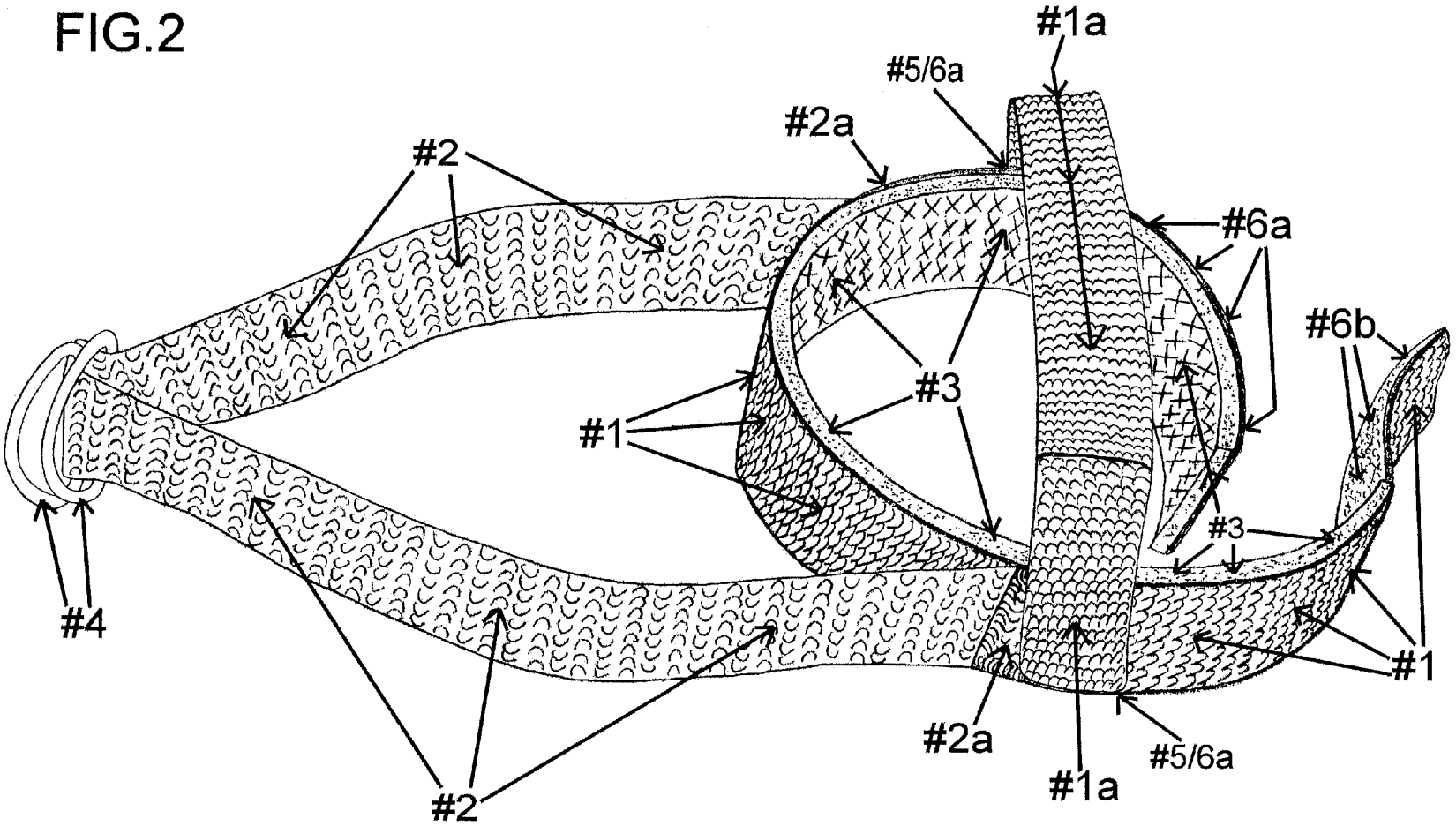
FIG. 2 is an upper perspective side illustration of this exercise device in the unsecured position with the retaining head strap [FIG. 1A] as shown attached to the device.
Figure 4:
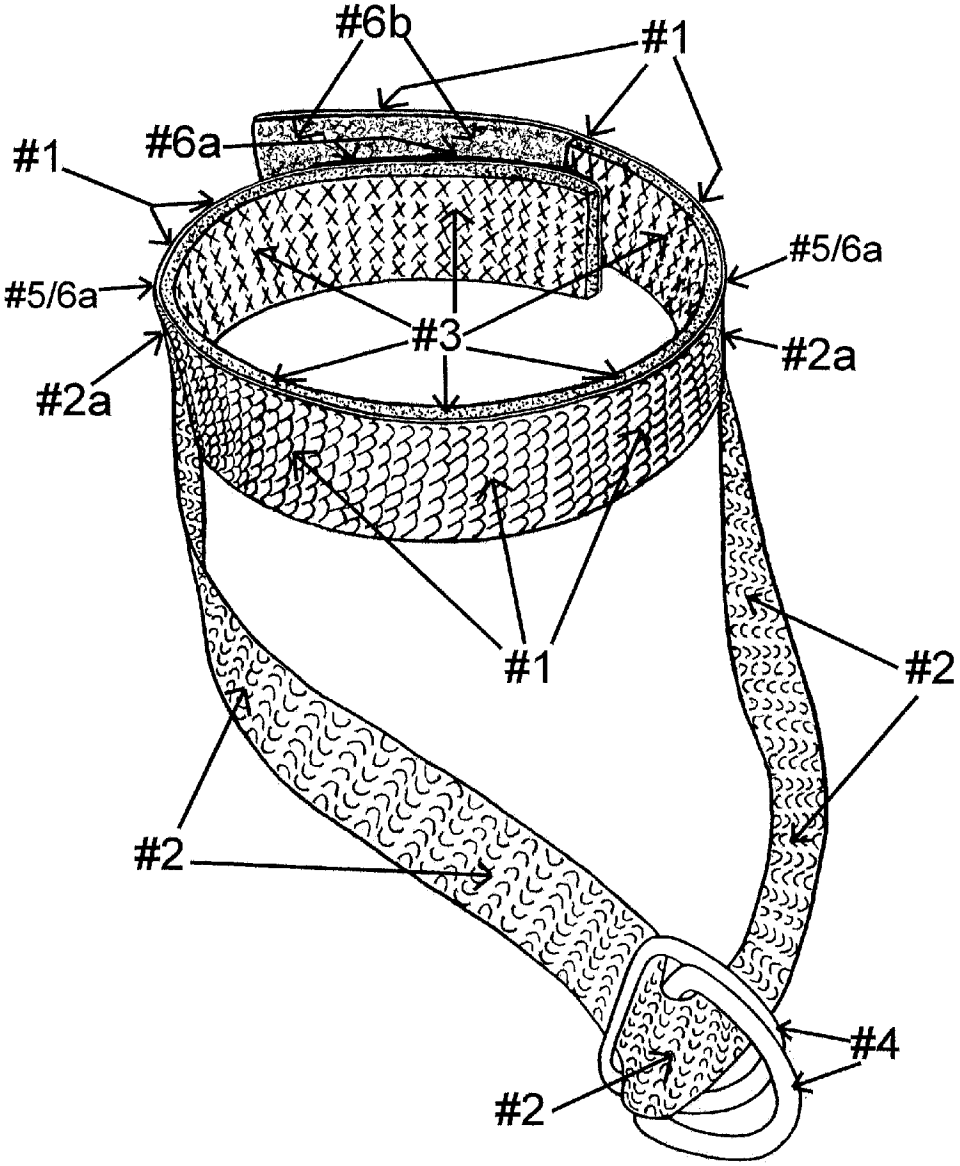
FIG. 4 is an upper perspective forward illustration of this exercise device in the unsecured position without the retaining head strap [FIG. 1A].

Item #6*b* indicates the Velcro [loop] material pad, [not visible], attached [as sewn] onto one end of the cotton strap [#1], inner side as shown secured to the Velcro [hook #6*a*] material pad, [not visible] which is attached [as sewn] on to the opposing end outer side of the cotton strap [#1] of this exercise device. An illustration of this Velcro [loop #6*b*] material pad is shown and is visible in FIG. 2 & FIG. 4.

FIG. 1A

Illustrates the cotton webbing retaining head strap [#1*a*] with two Velcro [loop, #6*b*] material pads attached [as sewn] onto the under or inner side of this cotton strap at each end. This head strap is attached to the neck exercise device with each end of the Velcro [loop #6*b*] material pads mating with the matching Velcro [hook #6*a*] material pads attached [as sewn] onto the exercise device at each of the prospective opposing points indicated as #5/6*a*. A view of this retaining head strap [#1*a*] attached to the neck exercise device is shown on FIG. 2.

FIG. 2

Illustrates this neck exercise device with all the components that comprise the device to be complete as follows:

Item #1 represents the cotton webbing strap material that provides the primary foundation with which all the other components shown and described are attached, in order for this device to provide the proper function as designed, constructed and intended for the user.

Item #1*a* represents the cotton webbing retaining head strap with the two Velcro [loop, #6*b*] material pads, [not visible] sewn onto the under or inner side at each end of this cotton webbing strap as shown attached to the Velcro (hook #6*a*) material pads, [not visible] on each of the opposing positions indicated as #5/6*a* to the exercise device.

Item #2 represents the nylon webbing strap material of which each end is attached [as sewn] onto the outer circumference of the cotton webbing strap [#1] at the designated opposing attachment points indicated as #2*a*. One of these attachment points is partially visible as shown on the side of this exercise device. The other attachment point #2*a* as indicated on the opposing side of this exercise device is not visible in this illustration [FIG. 1], but is shown and visible on FIG. 5. This nylon strap becomes the medium by which this device is able to perform the exercise functions as designed and intended for the user.

Item #3 represents a neoprene rubber type material which is attached to the inner circumference of the cotton strap [#1] by either being sewn on, or adhesively bonded. This rubber material [#3] attached to the cotton strap [#1] provides comfort to the user and prohibits movement of the device during use.

Item #4 indicates two alloy "D" configuration rings that are specifically incorporated within the construction of this device, in conjunction with the nylon strap [#2]. These "D" rings are used to facilitate the attachment from one end of an accessory resistance band/s, of which the other end of the resistance band/s would be anchored to a fixed point in order to complete the intended function and use of this exercise device.

Item #6*a* indicates the Velcro [hook] material pad, [not visible], attached [as sewn] onto one end of the cotton strap [#1], outer side shown unsecured. An illustration of this #6*a* pad is shown and is visible in FIG. 3

Item #6*b* indicates the Velcro [loop] material pad [partially visible] attached [as sewn] onto the other end of the cotton strap [#1], inner side as shown unsecured. An illustration of this #6*b* pad is also shown and is visible in FIG. 4

FIG. 3

Illustrates the exercise device with all the components that comprise the device to be complete as follows:

Item #1 represents the cotton webbing strap material that provides the primary foundation with which all the other components shown and described are attached, in order for this device to provide the proper function as designed, constructed and intended for the user.

Figure 5:
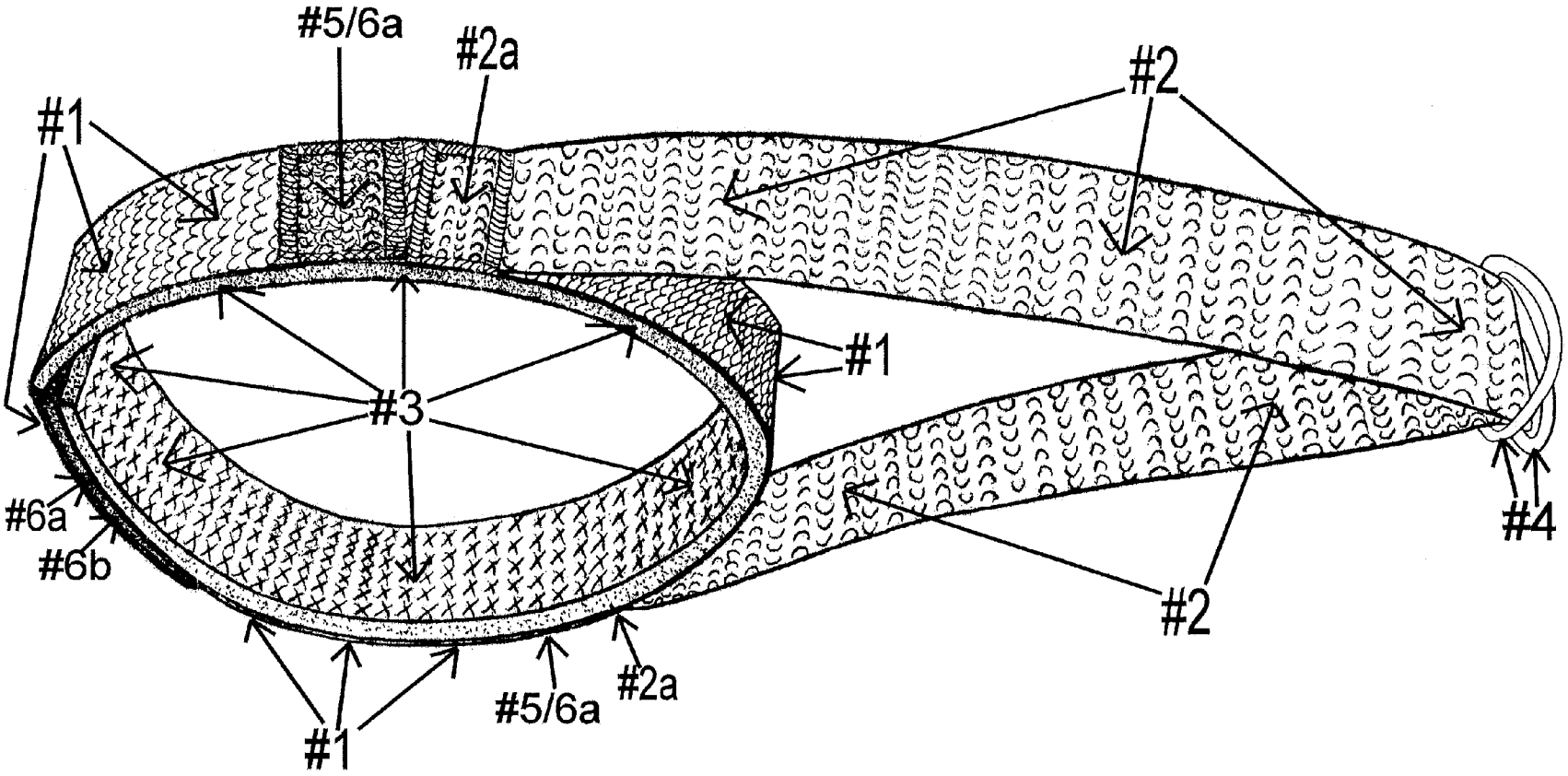
FIG. 5 is a lower perspective illustration of the opposing side of this exercise device in the secured position without the retaining head strap [FIG. 1A].

Item #2 represents the nylon webbing strap material of which each end is attached [as sewn] onto the outer circumference of the cotton strap [#1] at the designated opposing points indicated as #2*a*, not visible in this illustration, but shown and visible on FIG. 1 & FIG. 5. This nylon strap becomes the medium by which this device is able to perform the exercise functions as designed and intended for the user.

Item #3 represents a neoprene rubber type material which is attached to the inner circumference of the cotton strap [#1] by either being sewn on, or adhesively bonded. This rubber padding [#3] attached to the cotton strap [#1] provides comfort to the user and prohibits movement of the device during use.

Item #4 indicates two alloy "D" configuration rings that are specifically incorporated within the construction of this device, in conjunction with the nylon strap [#2]. These "D" rings are used to facilitate the attachment from one end of an accessory resistance band/s, of which the other end of the resistance band/s would be anchored to a fixed point in order to complete the intended function and use of this exercise device.

Item #5/6*a* indicates the two attachment points where which the Velcro [hook #6*a*] material pads, [not visible] are sewn onto the cotton strap [#1] and used to secure in place each opposing end of the retaining head strap Velcro [loop #6*b*] material pads illustrated in FIG. 1A. These indicator points [#5/6*a*] and Velcro [hook #6*a*] material pads are shown as attached and visible on FIG. 1 & FIG. 5

Item #6*a* indicates the Velcro [hook] material pad attached [as sewn] onto one end of the cotton strap [#1] outer side shown unsecured.

Item #6*b* indicates the Velcro [loop] material pad [not visible] attached [as sewn] onto the opposing end of the cotton strap [#1], inner side as shown unsecured. An illustration of this Velcro [loop #6*b*] material pad is shown and is visible in FIG. 4

FIG. 4

Illustrates the exercise device with all the components that comprise the device to be complete as follows:

Item #1 represents the cotton webbing strap material that provides the primary foundation with which all the other components shown and described are attached, in order for this device to provide the proper function as designed, constructed and intended for the user.

Item #2 represents the nylon webbing strap material of which each end is attached [as sewn] onto the outer circumference of the cotton strap [#1] at the designated opposing points indicated as #2*a*, not visible in this illustration, but shown and visible on FIG. 1 & FIG. 5. This nylon strap becomes the medium by which this device is able to perform the exercise functions as designed and intended for the user.

Item #3 represents a neoprene rubber type material which is attached to the inner circumference of the cotton strap [#1] by either being sewn on, or adhesively bonded. This rubber padding [#3] attached to the cotton strap [#1] provides comfort to the user and prohibits movement of the device during use.

Item #4 indicates two alloy "D" configuration rings that are specifically incorporated within the construction of this device, in conjunction with the nylon strap [#2]. These "D" rings are used to facilitate the attachment from one end of an accessory resistance band/s, of which the other end of the resistance band/s would be anchored to a fixed point in order to complete the intended function and use of this exercise device.

Item #5/6*a* indicates the two attachment points where which the Velcro [hook #6*a*] material pads, [not visible] are sewn onto the cotton strap [#1] and used to secure in place each opposing end of the retaining head strap Velcro [loop #6*b*] material pads illustrated in FIG. 1A. These indicator points [#5/6*a*] and Velcro [hook #6*a*] material pads are shown as attached and visible on FIG. 1 & FIG. 5

Item #6*a* indicates the Velcro [hook] material pad [not visible] attached [as sewn] onto one end of the cotton strap [#1] outer side shown unsecured. This Velcro [hook #6*a*] material pad is shown and visible in FIG. 3

Item #6*b* indicates the Velcro [loop] material pad shown partially visible, attached [as sewn] onto the opposing end of the cotton strap [#1], inner side as shown unsecured. This Velcro [loop #6*b*] pad is also shown and partially visible on FIG. 2

FIG. 5

Illustrates the exercise device with all the components that comprise the device to be complete as follows:

Item #1 represents the cotton webbing strap material that provides the primary foundation with which all the other components shown and described are attached, in order for this device to provide the proper function as designed, constructed and intended for the user.

Item #2 represents the nylon webbing strap material of which each end is attached [as sewn] onto the outer circumference of the cotton strap [#1] at the designated opposing points indicated as #2*a*. One of these attachment points is visible as shown on the side of this exercise device. The other attachment point #2*a* as indicated on the opposing side of this device is not visible in this illustration [FIG. 5], but is shown and visible on FIG. 1. This nylon strap becomes the medium by which this device is able to perform the exercise functions as designed and intended for the user.

Item #3 represents a neoprene rubber type material which is attached to the inner circumference of the cotton strap [#1] by either being sewn on, or adhesively bonded. This rubber padding [#3] attached to the cotton strap [#1] provides comfort to the user and prohibits movement of the device during use.

Item #4 indicates two alloy "D" configuration rings that are specifically incorporated within the construction of this device, in conjunction with the nylon strap [#2]. These "D" rings are used to facilitate the attachment from one end of an accessory resistance band/s, of which the other end of the resistance band/s would be anchored to a fixed point in order to complete the intended function and use of this exercise device.

Item #5/6*a* indicates the two attachment points where which a Velcro [hook #6*a*] material pad is sewn onto the outer circumference on each opposing side of the cotton strap [#1] and used to secure in place each end of the retaining head strap illustrated in FIG. 1A. One of these attachment points #5/6*a* and the Velcro [hook #6*a*] material pad is visible as shown on the side of this exercise device. The other attachment point #5/6*a* and Velcro [hook #6*a*] material pad as indicated on the opposing outer side of this exercise device is not visible in this illustration [FIG. 5], but is shown and visible on FIG. 1.

Item #6*a* indicates the Velcro [hook] material pad, [not visible], attached [as sewn] onto one end of the cotton strap [#1], outer side as shown secured to the Velcro [loop #6*b*] material pad, [not visible] on the opposing end of the cotton strap [#1], inner side of this exercise device. An illustration of this Velcro [hook #6*a*] material pad is shown and visible in FIG. 3

Item #6*b* indicates the Velcro [loop] material pad, [not visible], attached [as sewn] onto one end of the cotton strap [#1], inner side as shown secured to the Velcro [hook #6*a*] material pad, [not visible] attached to the opposing end outer side of the cotton strap [#1] of this exercise device. An illustration of this Velcro [loop #6*b*] material pad is shown and is visible in FIG. 2 & FIG. 4

What is claimed is:

1. A neck exercise harness comprising:

(a) an elongated cotton strap having first and second sides, said first side having a rubber surface for engagement with a user's head and said second side having Velcro fasteners for creating an adjustable closed loop around a user's head;

(b) an elongated nylon strap having ends sewn to said cotton strap;

(c) attachment rings movably attached to said nylon strap; said rings configured to attach to an exercise weight resistance;

(d) a head crown strap having Velcro fasteners adjustably attached to said cotton strap for adjustable positioning on the crown of a user; and wherein said cotton strap and said head crown strap are adjustably positioned on a user's head for providing a neck harness for resistive exercise.

* * * * *